United States Patent [19]

Dickey et al.

[11] 4,065,396

[45] Dec. 27, 1977

[54] MAGNESIUM OXIDE PROCESS

[75] Inventors: Charles R. Dickey, Covina; Vanderveer Voorhees, Los Altos, both of Calif.

[73] Assignee: Bray Oil Co., Los Angeles, Calif.

[21] Appl. No.: 420,625

[22] Filed: Nov. 30, 1973

Related U.S. Application Data

[63] Continuation-in-part of Ser. No. 9,488, Feb. 9, 1970, abandoned.

[51] Int. Cl.[2] ..... C10M 1/40

[52] U.S. Cl. ..... 252/33.4; 252/18; 252/33

[58] Field of Search ..... 252/18, 33, 33.4

[56] References Cited

U.S. PATENT DOCUMENTS

| | | | |
|---|---|---|---|
| 2,839,470 | 6/1958 | Warren et al. | 252/33 |
| 3,155,616 | 11/1964 | Vorhees | 252/18 X |
| 3,262,880 | 7/1966 | Vorhees | 252/18 X |
| 3,384,585 | 5/1968 | Gragson et al. | 252/18 X |
| 3,629,109 | 12/1971 | Gergel et al. | 252/33 |
| 3,865,737 | 2/1975 | Kemp | 252/33.4 |

OTHER PUBLICATIONS

Hackh's Chemical Dictionary, 1969, p. 402, "Magnesium Oxide".

*Primary Examiner*—Delbert E. Gantz
*Assistant Examiner*—Andrew H. Metz
*Attorney, Agent, or Firm*—Thomas A. Schenach

[57] ABSTRACT

It has been discovered that, whereas magnesium oxide of commerce, usually made by roasting hydrated magnesia, is inert to the action of $CO_2$ and methanol, when the oxide is made by roasting magnesium carbonate at a critical temperature in the range of 600°-1200° F., it dissolves rapidly in anhydrous methanol under $CO_2$ pressure, to form a methylate-carbonate. The complex can be emulsified with lubricating oil in the presence of an oil soluble surface active agent, particularly magnesium mahogany sulfonate, to produce an additive for lubricating oil having a high alkali value in the range of 100–400 mg. KOH per gram.

1 Claim, 1 Drawing Figure

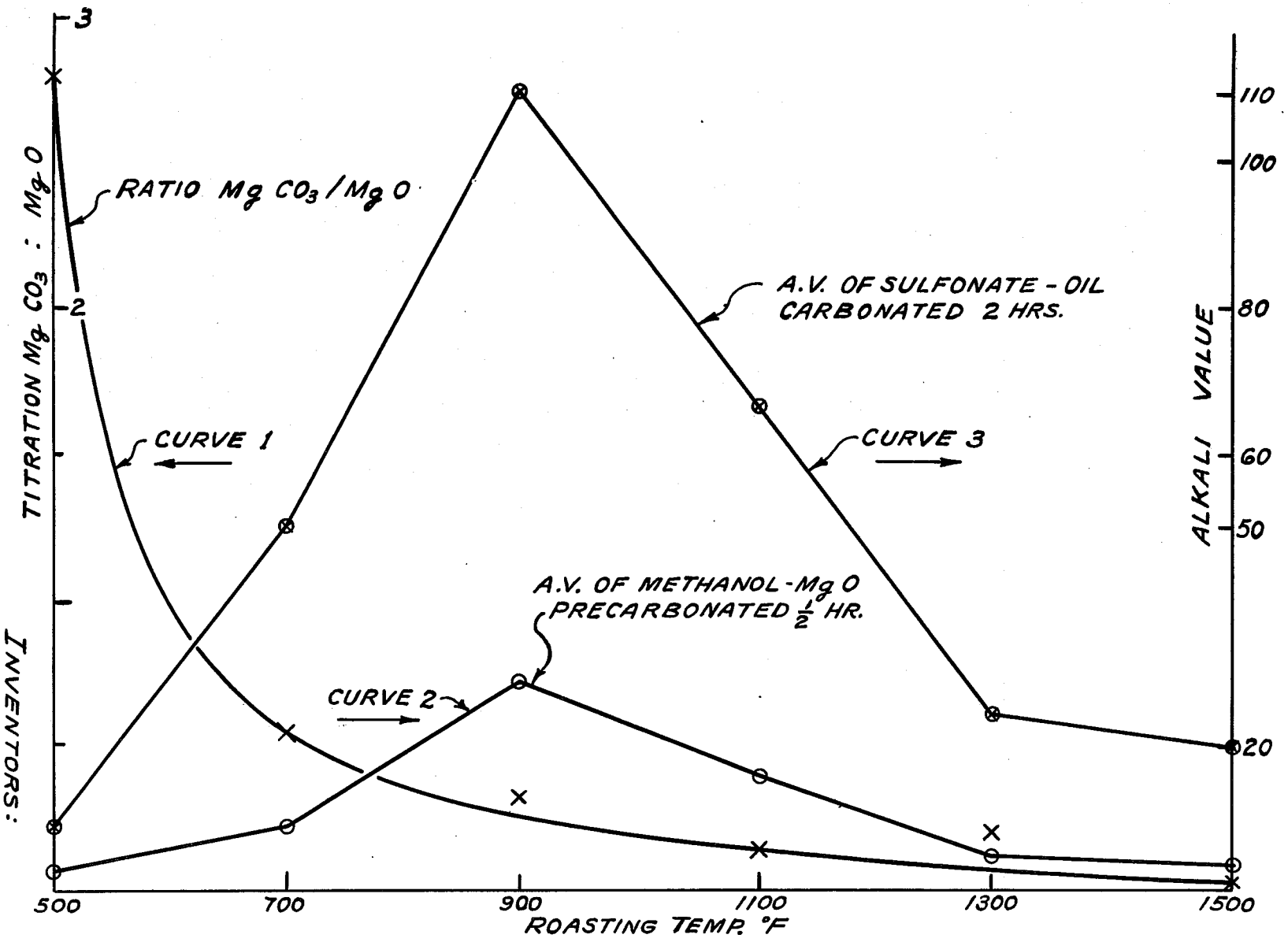
INVENTORS:
CHARLES R. DICKEY
VANDERVEER VOORHEES

MAGNESIUM OXIDE PROCESS

This application is a continuation in part of our application Ser. No. 9,488 filed Feb. 9, 1970 and now abandoned.

This invention relates to the dispersion of magnesium salts in oils and particularly to colloidal dispersion of magnesium carbonate —$MgCO_3$— in lubricating oils. More particularly, it relates to transparent colloidal dispersions of $MgCO_3$ in lubricating oils containing oil soluble sulfonates as surface active dispersing agents, providing lubricating oil additives of high reserve alkalinity in which the carbonate particles have a diameter generally less than 0.1 micron. The invention also relates to colloidal dispersions of magnesium carbonate in anhydrous methanol.

The invention is illustrated by a drawing showing graphically the unexpected reactivity of the magnesium oxide employed in our process.

Heretofore, it has been discovered that the performance of lubricating oils, especially the oils used in internal combustion engines, can be greatly improved by incorporating basic salts of metals, particularly the metals of Group II of the Periodic System of Elements. Such motor oils are said to possess "reserve alkalinity" and will remain neutral in service where subjected to contamination by acids of combustion, thus avoiding sludge formation caused by acid-catalyzed reactions. Many patents have been issued describing the manufacture of such oils, among them being Campbell et al. — U.S. Pat. No. 2,485,861; Van Ess et al. — U.S. Pat. No. 2,585,520; Groot — Australia Pat. No. 210,336; Schlicht et al. — U.S. Pat. No. 3,057,896; Carlyle — U.S. Pat. No. 3,021,280, Carlyle — U.S. Pat. No. 2,861,951; McMillen — U.S. Pat. No. 3,027,325; Kemp et al. — U.S. Pat. No. 2,982,726; Le Suer et al. — Canada Pat. No. 570,814; Voorhees — U.S. Pat. No. 3,170,880; and Gergel — U.S. Pat. No. 3,629,109.

A variety of reactions have been used to obtain the desired dispersion of basic salts, but, for reasons of cost and simplicity of operation, the most common method involves the solubilization of a metal oxide or hydroxide in water or an alcohol, particularly methanol, in the presence of carbonic acid — $CO_2$ — and dispersion of the resulting complex in oil and sulfonate followed by removal of the alcohol. This reaction proceeds most easily with barium oxide whereas with calcium oxide some difficulty is often encountered owing to the manner of preparation of the oxide. When prepared by dehydration or roasting the $Ca(OH)_2$ at 1200° to 1800° F., for example, the reaction proceeds very rapidly, whereas when the usual CaO from roasting calcium carbonate (limestone) is used, it often must be activated by pretreatment with acid such as acetic or carbonic — $CO_2$. (U.S. Pat. Nos. 3,155,616 and 3,155,617). When magnesium oxide of commerce was tried in this reaction, employing methanol and $CO_2$, the reactivity was negligible, owing perhaps to the low basicity of the oxide or the lower solubility of the hydroxide in comparison with calcium or barium oxide. Consequently, it has been the practice when making overbased magnesium sulfonates to employ magnesium methylate which is readily made from methanol and magnesium metal. The methylate solution is mixed with the oil and sulfonate and carbonated by injecting $CO_2$ into the mixture, from which the methanol is subsequently recovered by distillation.

The principal objection to this method is the relatively high cost of magnesium metal when compared with the oxide which is available in plentiful supply, made by roasting the hydroxide precipitated from brines by action of dolomitic lime, the magnesium in the lime also contributing to the supply of hydroxide. Numerous grades of oxide are commercially available depending on the manner of precipitation from the brine, particle size, manner of roasting, etc. When employed in the chemical industry, some grades are more active than others and are classified as "highly active". Attempts to use these so-called "active" oxides in the overbasing process with methanol and $CO_2$, however, have all failed. The resulting oils have had relatively low alkali value and have usually been cloudy or muddy in appearance or impossible to filter.

We have now discovered that, when the magnesium oxide is prepared from the carbonate instead of the hydroxide by roasting within a critical range of temperatures, the overbasing reaction proceeds satisfactorily in anhydrous methanol and the resulting oils are clear and of high alkalinity. The accompanying graphs show the results obtained with magnesium oxide made from the carbonate by roasting at different temperatures ranging from 500° to 1500° F. in an electrically heated muffle furnace for a period of four hours — sufficient time to reach equilibrium. The carbonate used in these tests was finely powdered U.S.P. grade. After roasting, the oxide was held in tightly closed containers to avoid deterioration from atmospheric moisture.

Each oxide was tested under identical conditions as follows: 16.5 grams of oxide were mixed in a turbine mixer with 300 cc. of anhydrous methanol (water content less than 0.2% by Karl Fischer). $CO_2$ was passed in at atmospheric pressure at the rate of 0.85 liters per minute. Ambient temperature prevailed at about 80° F. No significant rise in temperature occurred from the reaction between the oxide and $CO_2$, in sharp contrast to the behavior of calcium and barium oxides.

After 30 minutes of agitation with $CO_2$, a 10 cc. sample was withdrawn and centrifuged to clear it of suspended oxide, then titrated to determine solubility of oxide in the methanol. The results are shown in the drawing by "Curve 2". To the mixture in the turbine reactor were then added 100 grams of magnesium sulfonate diluted with 100 cc. of xylene solvent. This sulfonate was prepared by sulfonating with oleum, a benzene alkylate heavy residue from alkylation of benzene with normal chlorparaffin of about 10–13 carbon atoms using $AlCl_3$ catalyst. After removal of sludge from the sulfonation, the sulfonic acid was neutralized with magnesium hydroxide or MgO washed with water, and dried. It had an alkali value of 3.0 mg. KOH per gram, a neutral sulfonate content (QAS) of 1.05% magnesium equivalent and a molecular weight of 455.

Carbonation was continued for a total of two hours, then the mixture was heated to 250° F. to remove methanol. The mix was then treated with 30 cc. water, dehydrated to 275° F. and filtered to remove unreacted oxide, using Hy Flo diatomaceous earth filter aid. The clear oil was then heated to 400° F. to remove xylene solvent and titrated for alkalinity using methyl orange indicator. Results are shown in the drawing by "Curve 3".

Each lot of oxide was also titrated to determine the ratio of base number by phenolphthalein indicator to base number by methyl orange indicator which shows the extent of conversion of carbonate to oxide achieved in the roast. These results are shown in the drawing by "Curve 1" which shows the mol ratio of carbonate to oxide. It will be observed that the residual $CO_2$ in the oxide ranges from about 1.0 to 0.1 mol per mol of oxide in the range of 600° to 1200° F. roasting temperature. The following is a tabulation of the activity data:

| Roasting Temp. ° F. | Alkali Value of Methanol | Alkali Value of Sulfonate |
|---|---|---|
| 500 | 3 | 9 |
| 700 | 9 | 50 |
| 900 | 29 | 110 |
| 1100 | 16 | 66 |
| 1300 | 5 | 24 |
| 1500 | 3.5 | 20 |

It was found that carbonation under pressure gave much higher alkali values in the case where magnesium oxide and methanol are employed with sulfonate-oil mixtures, unlike the behavior of calcium or barium oxides where no advantage results with $CO_2$ pressure above atmospheric. Even the magnesium oxide of commerce made from the hydroxide can be used to produce oil of relatively high alkali value, providing a large excess of the oxide is used. In this case, however, there is a serious problem of removing the excess unreacted oxide from the product oil by filtration. Uneconomic amounts of filter aid are required and the oil is cloudy or muddy in appearance. The following examples will illustrate the results obtained with "Magox HR-98", a "reactive grade" of oxide sold by the Basic Magnesium Company.

EXAMPLE 1

To 750 cc. of anhydrous methanol in a shaking reactor were added 85 grams of the above oxide and 750 cc. of xylene solvent and 250 grams of magnesium sulfonate —455 equivalent weight and 1.05% Mg, QAS. $CO_2$ gas was introduced while shaking at 75°–85° F. Pressure of $CO_2$ was increased from 200 psi to 500 psi during the course of the reaction — 5 hours. A sample of the product was stripped free of methanol, treated with water and dehydrated to 275° F., then filtered in solution in xylene to reduce viscosity. The filter rate was poor and the filtrate cloudy, after stripping off solvent. The alkali value was 282 or 37.4% of theory.

EXAMPLE 2

One hundred grams of $MgCO_3$—"Reagent" grade from Baker Chemical Company were roasted at 800° F. for eight hours, losing 39% of its weight. Further roasting for four hours at 850°–950° F. increased the loss of weight to 57%, after which no further loss in weight occurred. The product was a fine white poxder of crystalline structure.

Thirty grams of this oxide were suspended in 800 cc. anhydrous methanol in the pressure vessel and 250 grams of magnesium sulfonate (455 equivalent weight) in 800 cc. xylene solvent were added. Agitation by shaking was effected for 4 hours at about 100° F. while $CO_2$ was injected at intervals to make up for absorption between 200 and 500 psi. Almost no unreacted oxide could be seen in the liquid product which weighed 1810 grams. After removing methanol, water treating and stripping off solvent to 400° F., the product oil was only slightly hazy *without filtering.* Rapid filtration gave a clear oil of 260 alkali value showing that 96% of the theoretical amount of MgO was dispersed in the product.

EXAMPLE 3

Magnesium hydroxide paste produced by the Kaiser Aluminum & Chemical Company from seawater was carbonated in water suspension by injecting $CO_2$ into a turbine mixer until completely converted to the carbonate. The carbonate in the form of microscopic needles was filtered off with suction and dried to a porous cake in an oven at 185° F. The carbonate was then roasted in a muffle at 800°–1000° F. through a period of twenty hours. Loss in weight was 69% compared with the theory of 66.7% for $MgCO_3.2H_2O$ and 71.0% loss for $MgCO_3.3H_2O$. The resulting oxide was seen under the microscope to possess a needle or acicular structure.

Fifty grams of this oxide were suspended in 800 cc. methanol in the shaker reactor and to the mix were added 250 grams magnesium sulfonate (455 equivalent weight) diluted with 800 cc. xylene solvent. $CO_2$ was introduced at 250 to 500 psi while agitating, absorption being substantially complete in 25 minutes and the temperature rising from 85° to 98° F. The reaction was continued for four hours. Methanol was stripped from the product by introducing superheated vapor of xylene solvent to a temperature of 230° F. Water treating was effected by adding 100 cc. water, causing the pasty mass to "break" to a fluid solution which was stripped of water and solvent at 410° F. It then filtered rapidly with Hy Flo filter aid. The oil titrated 380 alkali value.

EXAMPLE 4

To check the possibility that $MgCO_3$ would react without roasting, a test was made on U.S.P. $MgCO_3$ in the same manner as above. Results were negative, showing the carbonate to be unreactive.

EXAMPLE 5

This test demonstrates that sulfonate of high alkali value can be made from our active magnesium oxide at atmospheric pressure if sufficient excess is employed. Thirty grams of the oxide prepared by roasting the carbonate at 825° F. were mixed with 300 cc. anhydrous methanol and 175 cc. xylene solvent. $CO_2$ was passed in for 40 minutes at room temperature while rapidly agitating in a turbine mixer. To the reaction was then added 100 grams of magnesium sulfonate in 125 cc. xylene solvent and $CO_2$ continued for a total time of six hours. Methanol was then evaporated to a temperature of 295° F., cooled, then 50 cc. water was added and the oil dehydrated to 295° F. After filtering with standard diatomaceous earth, the clear filtrate was freed of solvent at 410° F. The oil was bright and clear and titrated 305 alkali value. Calculated conversion of MgO — 47%.

EXAMPLE 6

To an agitated pressure vessel was added 1000 cc. anhydrous methanol and 34 grams MgO prepared by roasting $MgCO_3$ at 900° F. and stored in a sealed container about one month. The vessel was purged of air with $CO_2$, then pressured with $CO_2$ to 200 psi gage at 76° F. After 3.5 hours mixing, the contents were removed and the vessel rinsed with methanol. The cloudy solution measured 1280 cc. It was filtered rapidly through a suction funnel with a small amount of filter cell to remove undissolved solids giving an opalescent filtrate — 1220 cc. Opalescence apparently resulted from some moisture in the filter cell. Alkali value of the solution was 67 mg. KOH per cc equivalent, corresponding to a content of soluble MgO of 29.39 gm. or 86.3 percent of the 34 grams charged to the reactor.

From this solution was prepared an overbased sulfonate as follows: Methanol solution of colloidal $MgCO_3$ complex — 260 cc. Neutral magnesium sulfonate in xylene 50:50 — 114 cc (50 gm). Mixed and heated to 290° F. to remove methanol. Cooled and treated with 15 cc. water. Heated to 250° to remove water. Filtered rapidly with filter cell. The clear filtrate was heated to 400° F. to evaporate xylene and the clear, red oil was titrated giving an alkali value of 283 mg. KOH per gram equivalent. The neutral magnesium sulfonate employed above had a sulfonate content — solvent free — of 0.96 percent magnesium — QAS.

In view of the close analogy between magnesium and calcium, both members of the second group of elements in the Periodic Table, it was baffling that overbased sulfonates could not be made from the usual magnesium oxide or hydroxide, all attempts to accomplish this having failed heretofore. It is not fully understood why the oxide made from the carbonate by controlled roasting is active in this reaction, but we believe one factor may be a small amount of retained $CO_2$ which serves as a nucleous for further carbonation in methanol. The oil and emulsifying agent then absorb the resulting complex, shifting the reaction to completion under the proper conditions of temperature and $CO_2$ concentration. It may also be that the oxide made from the carbonate retains a unique porous crystalline structure facilitating re-carbonation. There are indications that the oxide made from the carbonate by our controlled temperature roast possesses an unstable structure which accounts for its reactivity with methanol and $CO_2$.

It will be observed from the data presented hereinabove that the most effective roasting temperatures lie in the range of 600° to 1200° F., higher temperatures being unfavorable. The oxide produced under these conditions needs only a minimum of grinding inasmuch as the carbonate made by precipitation from the hydroxide exists in the form of microscopic needles which decompose to fine crystalline particles on roasting. Such particles usually have a diameter between 0.1 and 1 micron. When the carbonate is derived from the pure mineral, magnesite, it should be ground to 300 mesh and finer before or after roasting.

Although we have described making overbased sulfonates, mostly having alkali values between 100 and 300, we can employ our process to give sulfonates of 400 alkali value in one stage without difficulty. By starting the reaction with sulfonate, having an initial alkali value above 100, for example, still more basic sulfonate can be made, e.g. 400–500 A.V. The alkali values referred to herein are determined by titration of a weighed sample of the oil with standard hydrochloric acid using methyl orange indicator for carbonated oils and expressing the results as milligrams KOH equivalent per gram. Neutral sulfonate is determined by titration with cetyl pyridinium bromide by the "Rapid Volumetric Method for Accurately Determining Certain Anionic Detergents with Cetyl Pyridinium Bromide"; California Research Corporation File 172,270, (400.20) Jan. 12, 1950. The values are expressed as percent calcium or magnesium equivalent to the neutral sulfonate and are known as the Q.A.S. values (quaternary ammonium sulfonate).

In our process of overbasing oil with active MgO, $CO_2$ and methanol, we employ a ratio of 1 to 5 volumes of methanol per volume of oil treated, preferably at least 3 volumes and, when employing $CO_2$ under pressure, we prefer to use 100 to 500 psi pressure or at least 50 psi. dissolved $CO_2$ and anhydrous methanol can easily be recovered from this product. Reaction time usually runs from one to five hours. Temperatures of 80° to 150° F. are satisfactory and higher temperatures up to 200° F. can be advantageous in reducing reaction time. Petroleum xylene solvent boiling at about 280°–300° F. is convenient. Other hydrocarbon solvents can be used, such as toluene or petroleum naptha, varnish makers and painters naptha, Stoddard solvent and the like. The amount of hydrocarbon solvent may vary from about one to three volumes per volume of sulfonate-oil employed. The sulfonate content of the lubricating oil can vary from about 25 to 60% by weight of the oil mixture charged. It can be made by direct sulfonation of aromatic lube stocks in the manner well known in the art or by sulfonation of benzene alkylates of 400 to 600 molecular weight. These may then be diluted with lubricating oil distillates, usually of 100 to 500 Saybolt Universal viscosity at 100° F.

Although methanol is our preferred lower alcohol for use in the carbonation reaction, we may also use other alcohols of not more than four carbon atoms such as isopropyl, tertiary butyl and methoxy ethanol.

The oils made by our process are characterized by a high degree of clarity and low sediment below 0.01%. Other dispersing agents than sulfonates can be used such as the fatty acids of 18 carbons or more, the phosphonic acids made from olefin polymers and $P_2S_5$ with 20 to 60 carbon atoms, as well as the sulfonated alkyl benzenes of 20 to 50 carbon atoms. The oil soluble dispersant can be charged to the reaction as the free acid or in the form of its neutral salt with a basic metal, usually magnesium, but also with calcium, barium or lithium.

Having thus described our invention and without limitation to any theory of reaction expressed herein, we claim:

1. In the process of preparing a colloidal dispersion of magnesium carbonate in a lower alcohol of 1 to 4 carbon atoms by the simultaneous action of magnesium oxide and $CO_2$, the improvement comprising preparing the said magnesium oxide by roasting magnesium carbonate at a temperature of 800°–900° F. and cooling the resulting oxide in the absence of moisture, thereby producing an oxide having a crystal structure rendering it reactive with alcohol and $CO_2$, then contacting said oxide with said alcohol and $CO_2$ and a temperature of about 80° to 200° F. to form said colloidal dispersion.

* * * * *